US006857672B1

(12) United States Patent
Drew, II

(10) Patent No.: US 6,857,672 B1
(45) Date of Patent: Feb. 22, 2005

(54) DEAD BOLT REINFORCING PLATE FOR FRAMING STUD

(76) Inventor: John H Drew, II, 75 Rollie Deal Rd., Bristol, GA (US) 31518

( * ) Notice: Subject to any disclaimer, the term of this patent is extended or adjusted under 35 U.S.C. 154(b) by 0 days.

(21) Appl. No.: 10/719,849

(22) Filed: Nov. 24, 2003

(51) Int. Cl.[7] ..... E05B 15/02

(52) U.S. Cl. ..... 292/341.18; 292/340; 292/346; 292/DIG. 55; 52/204.1

(58) Field of Search ..... 292/340, 341.14, 292/341.18, 341.19, 346, DIG. 55, 341.13, DIG. 53, DIG. 60; 70/416–418; 49/360–361, 460–462; 52/211–217, 204.1

(56) References Cited

U.S. PATENT DOCUMENTS

| | | | | | |
|---|---|---|---|---|---|
| 2,127,891 | A | * | 8/1938 | Starling | 292/346 |
| 2,695,807 | A | * | 11/1954 | Bissot | 292/341.18 |
| 2,713,506 | A | * | 7/1955 | Wickstrom | 292/341.18 |
| 3,673,605 | A | * | 6/1972 | Allenbaugh | 292/346 |
| 3,764,173 | A | * | 10/1973 | Griffith | 292/346 |
| 3,934,910 | A | * | 1/1976 | Radke | 292/346 |
| 4,012,929 | A | | 3/1977 | Solovieff | |
| 4,021,880 | A | * | 5/1977 | Murphy | 292/340 |
| 4,057,275 | A | | 11/1977 | La Beaud | |
| 4,474,394 | A | | 10/1984 | Crepinsek | |
| 4,489,968 | A | * | 12/1984 | Easley | 292/340 |
| 4,643,007 | A | | 2/1987 | Fish et al. | |
| 4,862,658 | A | * | 9/1989 | Barker et al. | 292/340 |
| 5,024,475 | A | | 6/1991 | Francis | |
| 5,127,690 | A | * | 7/1992 | Kim et al. | 292/340 |
| 5,566,995 | A | * | 10/1996 | Jagiela | 292/346 |
| 5,836,628 | A | | 11/1998 | Beier | |
| D417,516 | S | | 12/1999 | White | |
| 6,082,049 | A | * | 7/2000 | Hudson | 292/346 |
| 6,282,851 | B1 | * | 9/2001 | Beaton | 52/204.1 |
| 6,550,193 | B2 | * | 4/2003 | Potts | 52/204.1 |

* cited by examiner

*Primary Examiner*—Daniel P. Stodola
*Assistant Examiner*—Christopher Boswell

(57) ABSTRACT

A reinforcing plate includes a central portion having a centrally disposed longitudinal axis and a plurality of sidewalls. The central portion further includes a substantially rectangular slot for receiving a deadbolt therethrough. The sidewalls include a plurality of holes for receiving fastening members for attachment to a door frame. The plurality of sidewalls extend outwardly and away from the central portion and a door frame, forming a substantially U-shape. In an alternate embodiment, the central portion includes a female portion with an edge portion having a slot formed therein. The central portion further includes a male portion with an edge portion positionable within the slot of the female portion, so that the width of the central portion can be selectively adjusted in a direction substantially perpendicular to the axis and to fit a variety of framing studs.

6 Claims, 5 Drawing Sheets

DEAD BOLT REINFORCING PLATE FOR FRAMING STUD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates generally to strike plates for dead bolts and, more particularly, to a steel-reinforced strike plate for dead bolts in wooden door jambs.

2. Prior Art

Conventional strike plates provide little protection against unauthorized entry into a house or building with wooden doorjambs. The strike plate used with most door assemblies consists of a small flat plate provided with an aperture to receive a door latch or dead bolt. The strike plate is typically attached to the doorjamb with several small screws. As such, unauthorized entry into houses and buildings can often be attained merely by striking a hard blow to the door with a heavy object or by kicking the door. The force exerted on the doorjamb by the latch or dead bolt splits the doorjamb in the vicinity of the door latch assembly, thereby allowing the door to open.

Numerous devices have been previously proposed for reinforcing a doorjamb, and many of these devices have achieved varying degrees of success. However, such devices are either externally mounted to the doorjamb thereby affecting the operation and aesthetic appearance of the door or they are mounted on the doorjamb such that forces exerted on the door are not effectively distributed across the doorjamb. To this end, a need has long existed for a doorjamb reinforcing apparatus that is internally mountable and which will effectively distribute forces exerted on a doorjamb during an attempted forced entry. It is to such an improved doorjamb reinforcing apparatus that the present invention is directed.

BRIEF SUMMARY OF THE INVENTION

In view of the foregoing background, it is therefore an object of the present invention to provide an apparatus for a dead bolt reinforcing plate. These and other objects, features, and advantages of the invention are provided by a dead bolt reinforcing plate having a central portion with a centrally disposed longitudinal axis and a width extending across a framing stud disposed adjacent to a door frame. The central portion has a slot formed therein for selectively receiving a dead bolt therethrough so that same is able to pass through a door frame and partially pass through a framing stud.

The reinforcing plate further includes a plurality of opposed sidewalls, integral with the central portion and spaced equally apart from the axis, to thereby form a substantially U-shape. The plurality of sidewalls extend substantially parallel to the axis, along a length of the central portion, and outwardly and away from the central portion and door frame. The plurality of sidewalls have a plurality of holes spaced therealong, respectively, and extend substantially perpendicularly from the central portion. A plurality of fastening members are removably insertable into the plurality of holes for securing the plate to a framing stud adjacent a door frame.

In an alternate embodiment of this invention, the central portion preferably includes a female portion with an edge portion having a substantially rectangular slot formed therein and extending substantially parallel to the axis. The central portion further includes a male portion with a narrow edge portion selectively positionable within the slot of the female portion, so that the width of the central portion can be adjusted in a direction substantially perpendicular to the axis to fit a variety of framing studs. Similar to the previous embodiment, the plurality of sidewalls extend outwardly and away from the central portion and a door frame, to thereby form a substantially U-shape.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
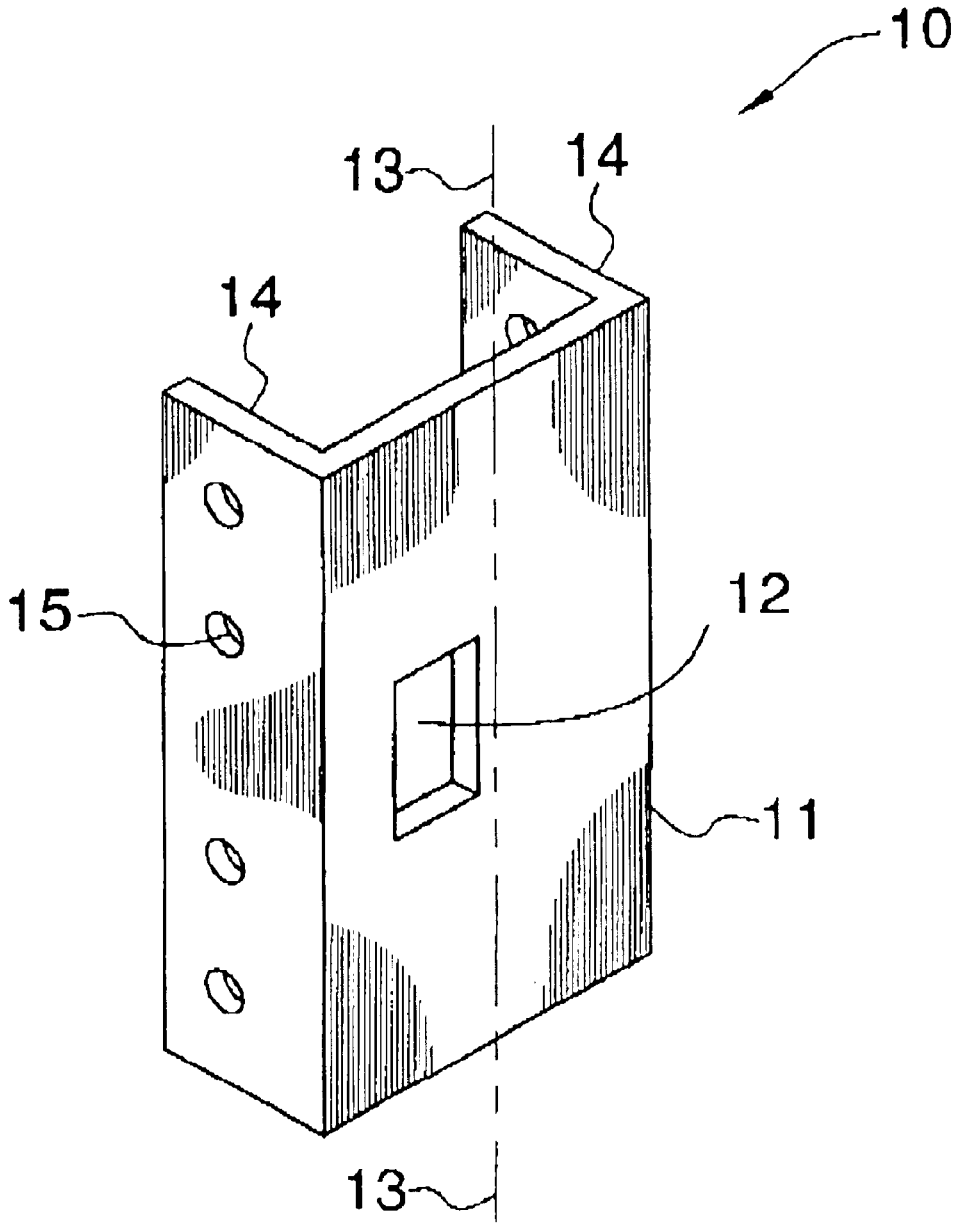
FIG. 1 is a perspective view of the reinforcing plate, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout and prime and double prime numbers refer to alternate embodiments of such elements.

The apparatus of this invention is referred to generally in FIGS. 1–5 by the reference numeral 10 and is intended to provide a dead bolt reinforcing plate to reinforce door frames 31. It should be understood that the dead bolt reinforcing plate 10 may be used to reinforce many different sizes of door frames 31, in both commercial and residential applications.

Figure 2:
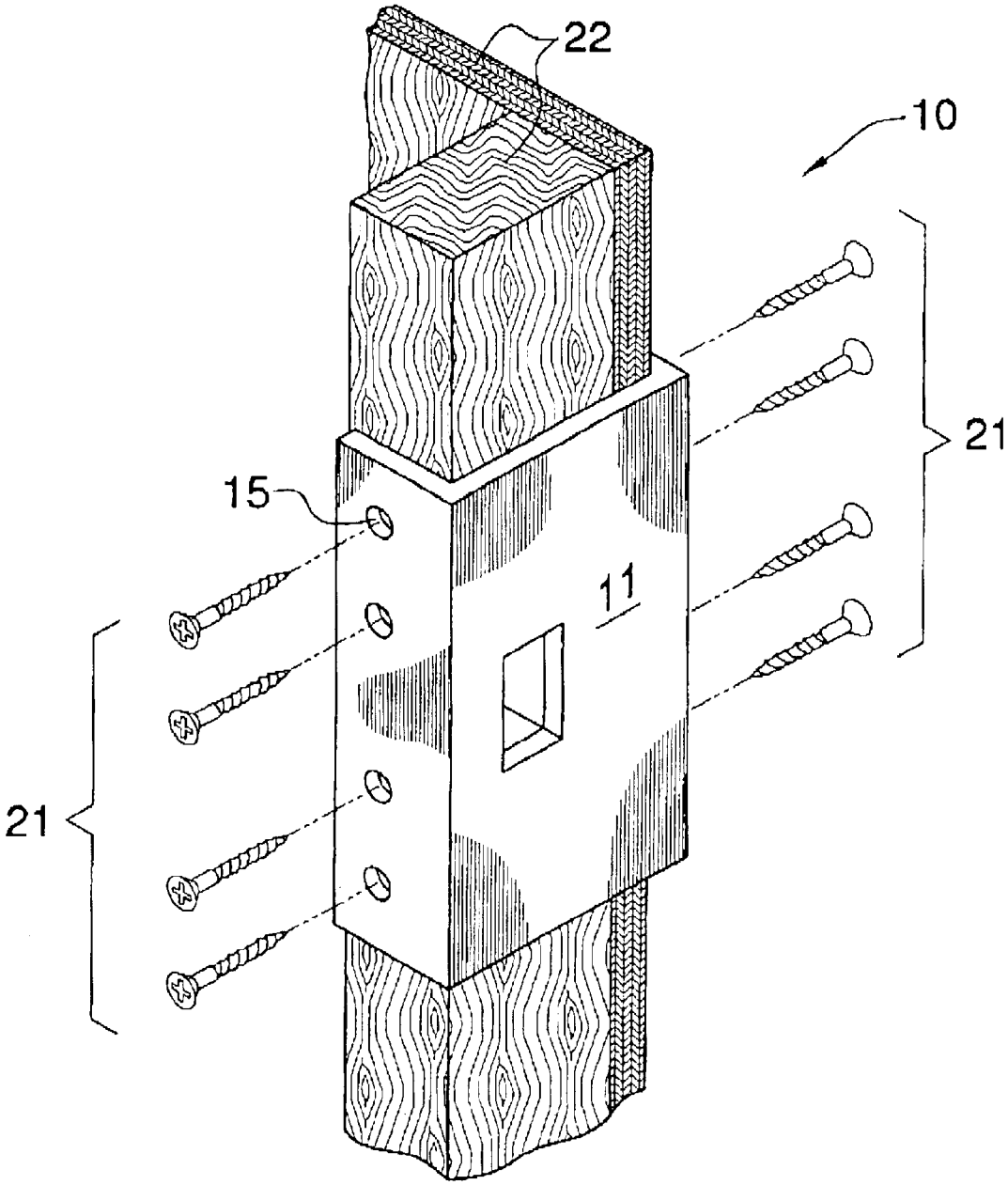
FIG. 2 is a perspective view showing the reinforcing plate of FIG. 1 mounted about a pair of framing studs.
Figure 3:
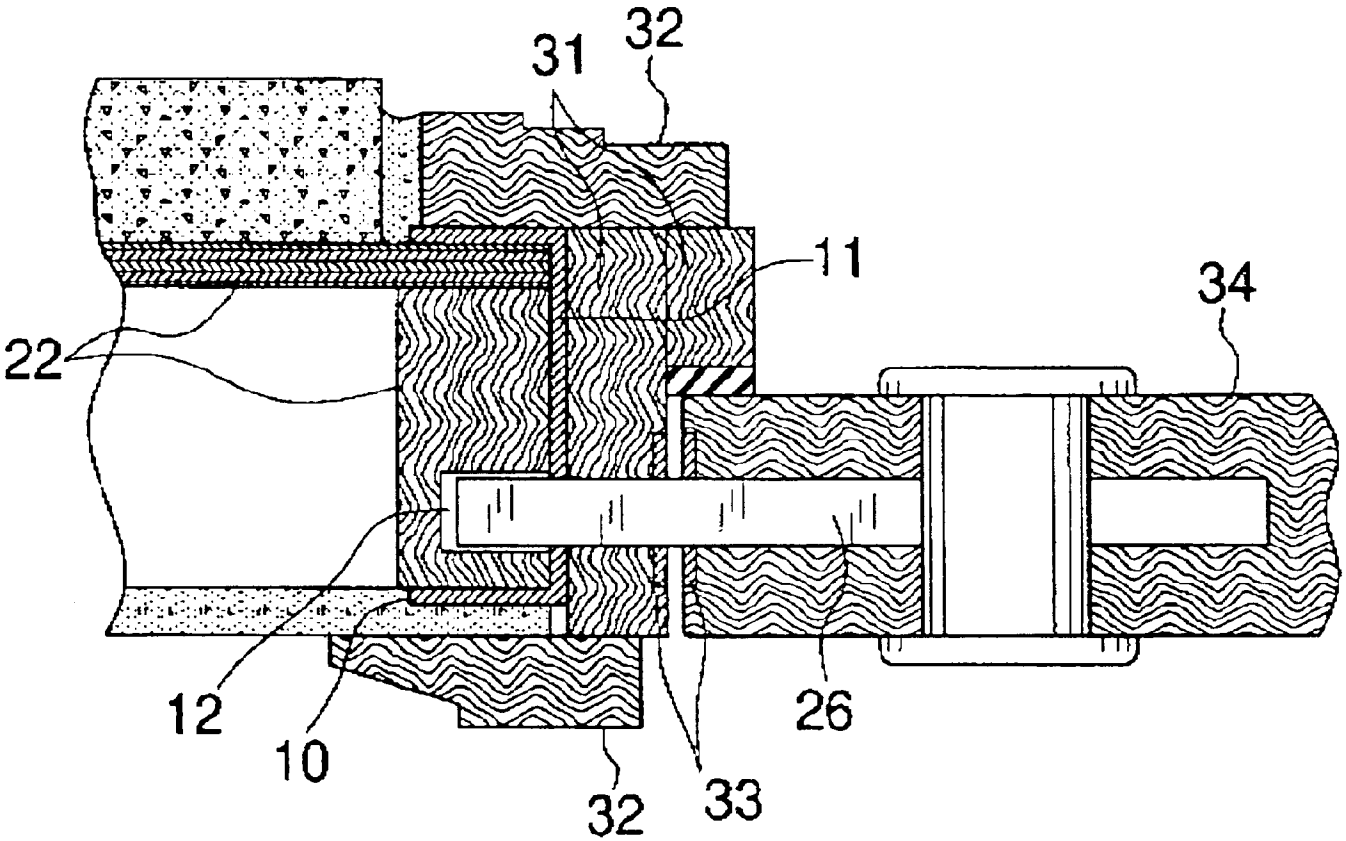
FIG. 3 is a cross sectional view of FIG. 2 illustrating an elongated dead bolt disposed within the slot of the reinforcing plate.

Referring to FIGS. 1 and 2, the reinforcing plate 10 includes a central portion 11 having a centrally disposed longitudinal axis 13 and a width extending across framing studs 22 disposed adjacent a door frame 31. The central portion 11 has a slot 12 having a substantially rectangular shape formed therein for selectively receiving a dead bolt 36 therethrough so that same is able to pass through a door frame 31 and partially pass through a framing stud 22, as perhaps best shown in FIG. 3. As clearly shown in FIG. 3, the reinforcing plate 10 is spaced from a conventional strike plate 33 wherein a dead bolt 36 can pass through both plates 10 and 33, for providing extra support.

A plurality of opposed sidewalls 14, integral with the central portion 11 and spaced equally apart from the axis 13, extend substantially parallel to the axis 13 and along a length of the central portion 11. The plurality of sidewalls 14 extend outwardly and away from the central portion 11 and a door frame 31, forming a substantially U-shape. A plurality of fastening members 21 such as common wood screws are removably insertable into a plurality of holes 15 for securing the reinforcing plate 10 to framing studs 22, as perhaps-best shown in FIG. 2.

Figure 4:
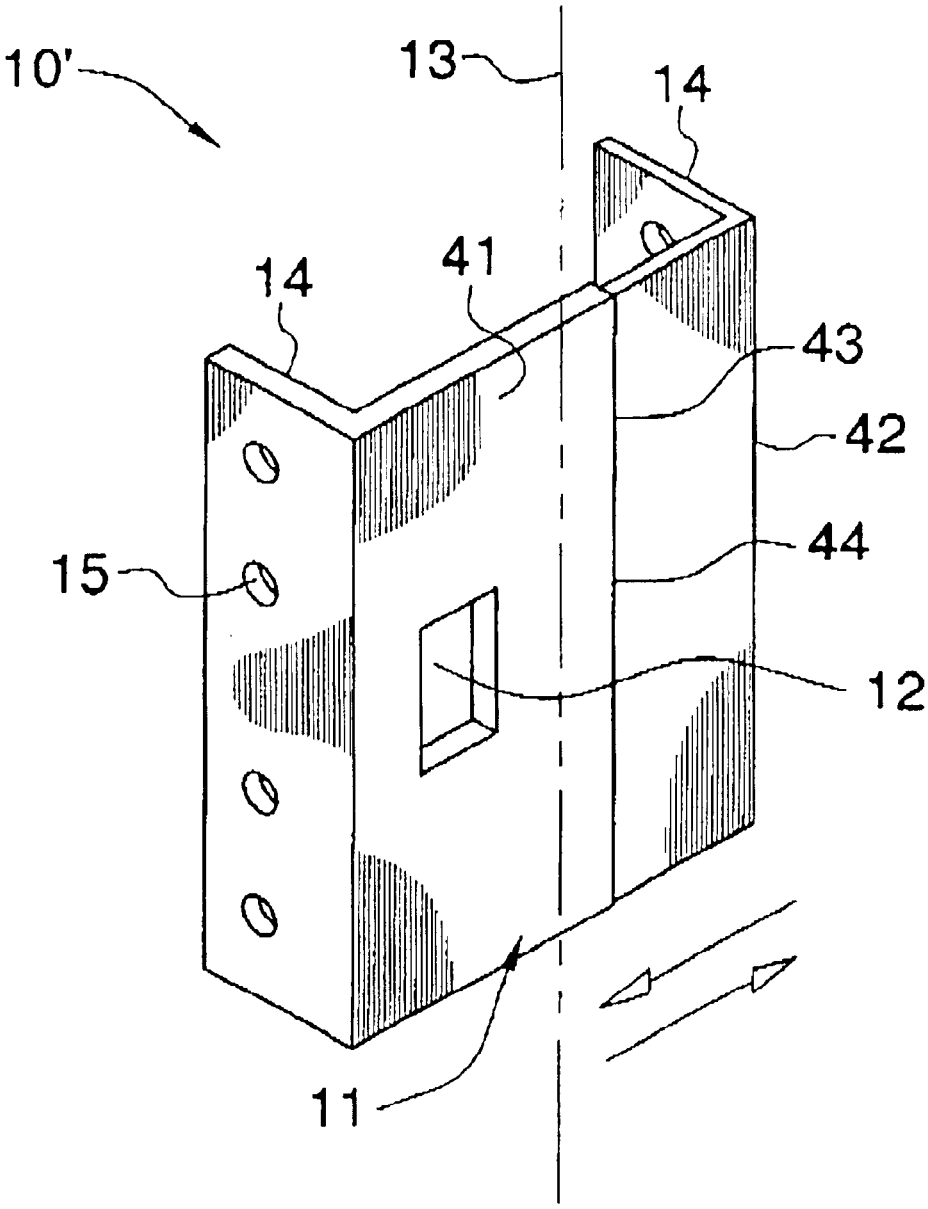
FIG. 4 is a perspective view showing an alternate embodiment of FIG. 1.
Figure 5:
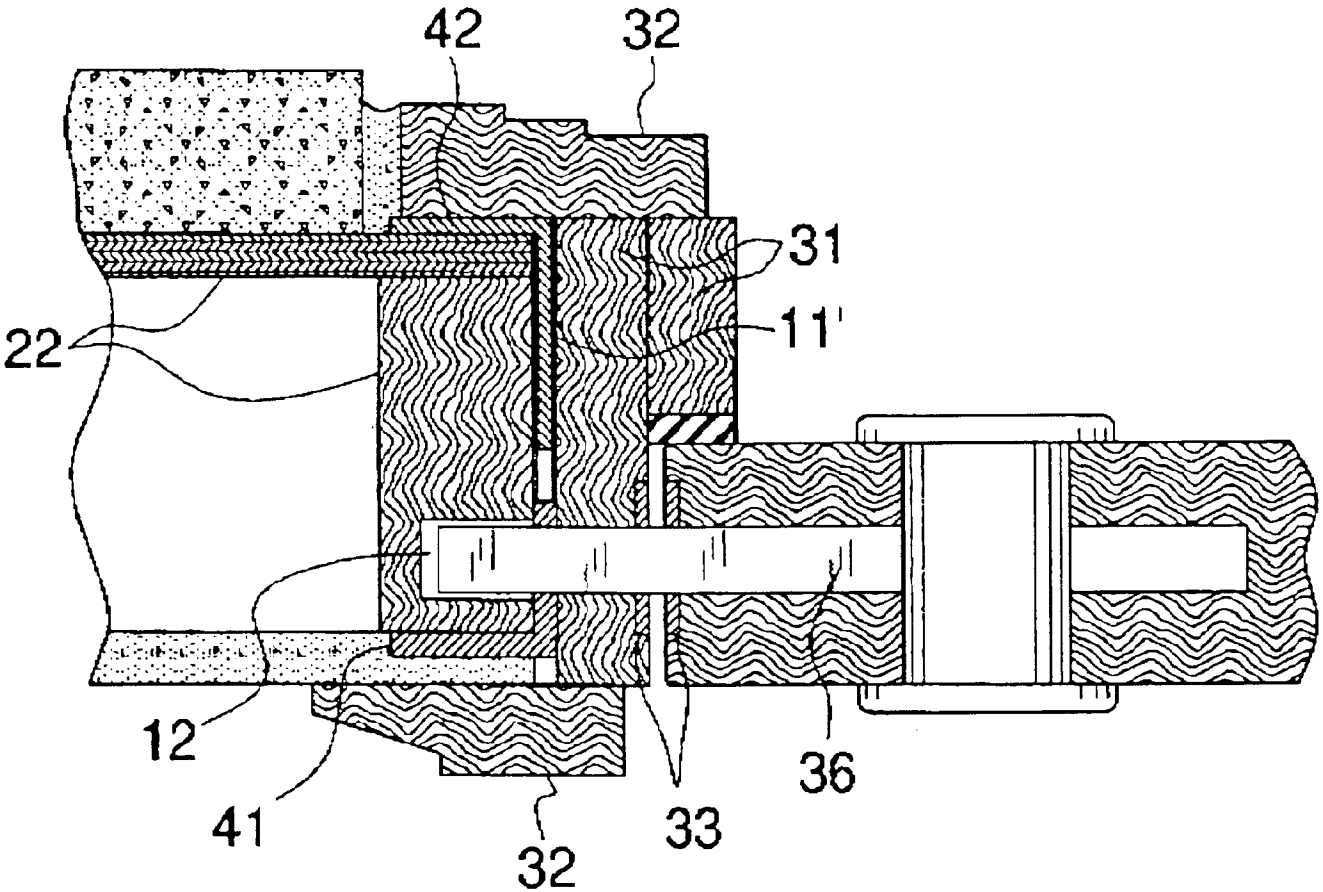
FIG. 5 is a cross sectional view of FIG. 4 illustrating an elongated dead bolt disposed within the slot of the reinforcing plate.

Now referring to FIG. 4, in an alternate embodiment, the central portion 11' may include a female portion 41 including an edge portion 43 having a slot formed therein and extending substantially parallel to the axis 13. The reinforcing plate 10' may further include a male portion 42 including an edge portion 44 narrower than the edge portion 43 of the female portion 41 and being selectively positionable with the slot 12 of the female portion 41' so that the width of the central portion 11' can be selectively adjusted in a direction substantially perpendicular to the axis 13 to fit a variety of framing studs, as perhaps best shown in FIG. 5. This enables a contractor to inventory only one size reinforcement plate to fit all applications, and reduce the number of trips to the hardware supplier.

The appealing features of the reinforcement plate 10 include ease of installation, compactness, reasonable price, and increased level of safety in conjunction with a standard dead bolt. Even if the installation of the exterior fastening members was prohibitive, due to the exterior finish, the reinforcing plate would still provide adequate protection if installed only on the interior door frame. Do-it-yourselfers and contractors alike would find it easy to install, saving time and money while improving security.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A dead bolt reinforcing plate comprising:

a central portion including a width extending across a framing stud disposed adjacent a door frame, said central portion having a slot formed therein and for selectively receiving a dead bolt therethrough so that same is able to pass through a door frame and partially pass through a framing stud, said central portion further including a centrally disposed longitudinal axis, said central portion including a female portion including an edge portion having a slot formed therein and extending substantially parallel to the axis, and a male portion including an edge portion selectively positionable within the slot of said female portion so that the width of said central portion can be adjusted to fit a variety of framing studs, the width of said central portion being adjustable in a direction substantially perpendicular to the axis, said male and female portions having substantially symmetrical shapes wherein said central portion slot is formed within said female portion, said edge portion slot being isolated from said central portion slot such that said central portion slot maintains a fixed shape when said male and female portions are slidably engaged;

a plurality of opposed sidewalls integral with said central portion and spaced equally apart from the axis, said plurality of sidewalls extending substantially parallel to the axis and along a length of said central portion, said plurality of sidewalls having a plurality of holes spaced therealong respectively, said plurality of sidewalls extending substantially perpendicularly from said central portion; and a plurality of fastening members removably insertable into said plurality of holes and for securing said plate to a framing stud adjacent a door frame.

2. The dead bolt reinforcing plate of claim 1, wherein said edge portion of said male portion is narrower than said edge portion of said female portion.

3. The dead bolt reinforcing plate of claim 1, wherein said slot of said central portion has a substantially rectangular shape.

4. The dead bolt reinforcing plate of claim 1, wherein said central portion and said plurality of sidewalls form a substantially U-shape.

5. The dead bolt reinforcing plate of claim 1, wherein said plurality of sidewalls extend outwardly and away from said central portion and a door frame.

6. A dead bolt reinforcing plate comprising:

a central portion including a width extending across a framing stud disposed adjacent a door frame, said central portion having a slot formed therein and for selectively receiving a dead bolt therethrough so that same is able to pass through a door frame and partially pass through a framing stud, said central portion further including a centrally disposed longitudinal axis, said central portion including a female portion including an edge portion having a slot formed therein and extending substantially parallel to the axis, and a male portion including an edge portion selectively positionable within the slot of said female portion so that the width of said central portion can be adjusted to fit a variety of framing studs, the width of said central portion being adjustable in a direction substantially perpendicular to the axis, said male and female portions having substantially shapes wherein said central portion slot is formed within said female portion, said edge portion slot being isolated from said central portion slot such that said central portion slot maintains a fixed shape when said male and female portions are slidably engaged;

a plurality of opposed sidewalls integral with said central portion and spaced equally apart from the axis, said plurality of sidewalls extending substantially parallel to the axis and along a length of said central portion, said plurality of sidewalls having a plurality of holes spaced therealong respectively, said plurality of sidewalls extending substantially perpendicularly from said central portion, said plurality of sidewalls extending outwardly and away from said central portion and a door frame; and a plurality of fastening members removably insertable into said plurality of holes and for securing said plate to a framing stud adjacent a door frame.

* * * * *